United States Patent [19]

Schnaibel et al.

[11] Patent Number: 5,040,513

[45] Date of Patent: Aug. 20, 1991

[54] OPEN-LOOP/CLOSED-LOOP CONTROL SYSTEM FOR AN INTERNAL COMBUSTION ENGINE

[75] Inventors: Eberhard Schnaibel, Hemmingen; Erich Schneider, Kirchheim, both of Fed. Rep. of Germany

[73] Assignee: Robert Bosch GmbH, Stuttgart, Fed. Rep. of Germany

[21] Appl. No.: 499,301

[22] PCT Filed: Nov. 3, 1988

[86] PCT No.: PCT/DE88/00679

§ 371 Date: May 14, 1990

§ 102(e) Date: May 14, 1990

[87] PCT Pub. No.: WO89/05397

PCT Pub. Date: Jun. 15, 1989

[30] Foreign Application Priority Data

Dec. 8, 1987 [DE] Fed. Rep. of Germany ..... 3741527

[51] Int. Cl.[5] ..... F02D 41/14; F02D 41/26

[52] U.S. Cl. ..... 123/488; 123/489

[58] Field of Search ..... 123/440, 489, 488

[56] References Cited

U.S. PATENT DOCUMENTS

| | | | |
|---|---|---|---|
| 4,546,747 | 10/1985 | Kobayashi et al. | 123/489 |
| 4,561,403 | 12/1985 | Oyama et al. | 123/489 |
| 4,594,984 | 6/1986 | Raff et al. | 123/440 |
| 4,639,870 | 1/1987 | Otobe et al. | 123/480 |
| 4,763,629 | 8/1988 | Okazaki et al. | 123/489 |

*Primary Examiner*—Tony M. Argenbright

*Assistant Examiner*—Robert E. Mates

*Attorney, Agent, or Firm*—Walter Ottesen

[57] ABSTRACT

An open-loop/closed-loop control system for adjusting the air/fuel mixture of an internal combustion engine 12 exhibits an oxygen probe (λ-probe) 14 which is exposed to the exhaust gas of the internal combustion engine 12 and which emits an output signal which represents a measure of the air ratio λ. The control system also has a basic memory 10 for storing fuel-metering times which are used for precontrolling the internal combustion engine 12 to a predetermined air ratio λ, a desired-value memory 18 for storing desired values of the air ratio and a closed-loop control device 20 which, in depedence on an output signal of the λ-probe 14 measured and on an associated desired value read out of the desired-value memory 18, corrects the particular fuel-metering time read out of the basic memory 10 and the desired-value memory 18 stores the inverse value of the air ratio λ. The fuel-metering time read out of the basic memory 10 is multiplicatively combined with the corresponding inverse value of the air ratio λ read out of the desired-value memory 18. A conversion device 16 converts, with the aid of an at least approximately known probe-characteristic relationship between the output signal of the λ-probe 14 and the air ratio λ, the output signal into a corresponding inverse value of the air vario λ. A fast and accurate control is achieved by means of a simple linear closed-loop control device by taking into consideration the linear relationship between the inverse value of the air ratio λ and the fuel quantity (fuel-metering time).

3 Claims, 1 Drawing Sheet

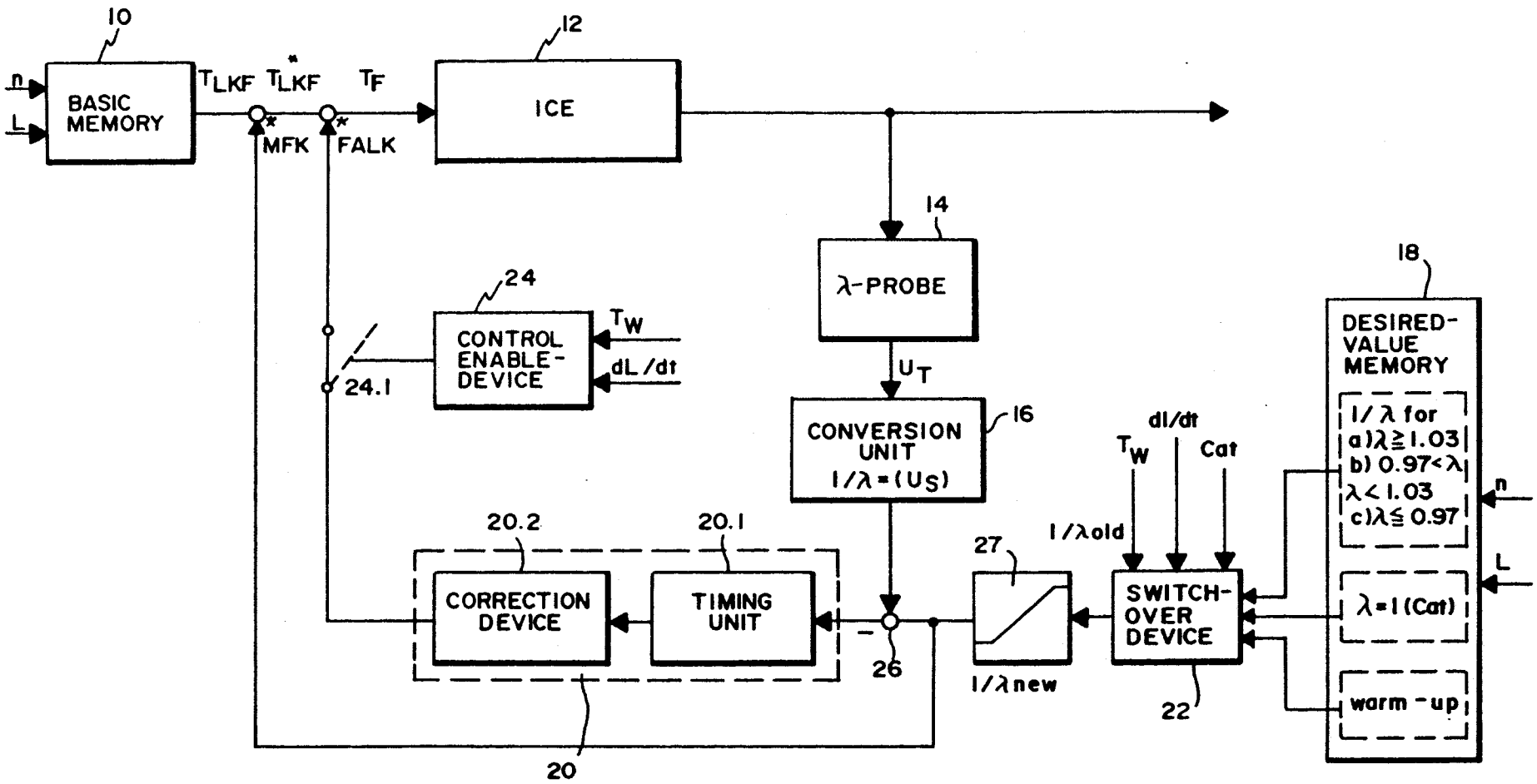
BASIC MEMORY
10
n
L
$T_{LKF}$
$T_{LKF}^*$
$T_F$
MFK
FALK
ICE
12
λ-PROBE
14
$U_T$
CONVERSION UNIT
1/λ = (Us)
16
CONTROL ENABLE-DEVICE
24
$T_W$
dL/dt
24.1
TIMING UNIT
20.1
CORRECTION DEVICE
20.2
20
26
27
1/λnew
1/λold
SWITCH-OVER DEVICE
22
Cat
dl/dt
$T_W$
DESIRED-VALUE MEMORY
18
1/λ for
a) λ≧1.03
b) 0.97<λ<1.03
c) λ≦0.97
λ=1 (Cat)
warm-up

OPEN-LOOP/CLOSED-LOOP CONTROL SYSTEM FOR AN INTERNAL COMBUSTION ENGINE

FIELD OF THE INVENTION

The invention relates to an open-loop/closed-loop control system for adjusting the air/fuel mixture of an internal combustion engine.

BACKGROUND OF THE INVENTION

Such systems have a λ-probe which is exposed to the exhaust gas of the internal combustion engine and which emits an output signal which represents a measure of the air ratio λ. In particular, a λ-probe is used, the characteristic of which has an essentially jump-like behavior in the region of $\lambda=1$ (Nernst-type λ-probe). Furthermore, the open-loop/closed-loop control system has a basic memory, a desired-value memory and a closed-loop control device. In the basic memory, fuel-metering times (for example, injection times for the injection valves of the internal combustion engine) are stored in dependence on operating parameters of the internal combustion engine and in the desired-value memory, desired values of the air ratio λ are stored in dependence on operating parameters of the internal combustion engine. The closed-loop control device corrects the fuel-metering time read out of the basic memory in dependence on an output signal of the λ-probe measured and on a corresponding desired value read out of the desired-value memory.

Low-pollutant vehicles are usually operated with a three-way catalytic converter arranged in the exhaust gas of the internal combustion engine. In order to ensure the optimum conversion rate of the catalytic converter, it is necessary that an air ratio of $\lambda=1$ is almost exactly maintained, that is the air ratio λ may only fluctuate by a particular permissible amount around the value of $\lambda=1$ (so-called catalytic converter window). In actual closed-loop control systems, control is frequently effected not exactly to $\lambda=1$ but to $\lambda\cong1$ (for example $\lambda=0.998$). In the text which follows, the term "$\lambda=1$ control" will still be used for reasons of simplification, this term also being intended to encompass $\lambda\cong1$.

If the arrangement of a catalytic converter is omitted, a further possibility for reducing particular pollutant components of the exhaust gases of an internal combustion engine consists in operating the internal combustion engine in the lean range ($\lambda>1$). Thus, a large decrease of the nitrogen monoxides (NOx) contained in the exhaust gas is achieved, for example, with an air ratio of $\lambda=1.4$. The carbon monoxide content (CO) of the exhaust gas is already very low at air ratios from $\lambda=1$. However, there is an increase in the hydrocarbon content (HC) of the exhaust gas with large air ratios (from $\lambda\cong1.1$). However, the driving characteristic of the internal combustion engine stands in the way of increasing the air ratio λ and the possible reduction in the pollutant components. To achieve an adequate driving characteristic of the internal combustion engine in any operating phase, it is necessary to enrich the air/fuel mixture in particular operating phases (for example idling, full load) by increasing the fuel quantity added so that values of the air ratio λ occur which, under certain circumstances, are less than 1.

To be able to reliably cover such a wide control range ($\lambda\cong0.9$ to 1.4) by closed-loop control techniques, it is necessary in accordance with the solutions available in the prior art to use several controllers or to achieve a switch-over between individual control ranges by means of elaborate circuit measures. A closed-loop control device for the mixture composition of an internal combustion engine with switchable control ranges for $\lambda=1$ range and lean range is known from U.S. Pat. No. 4,594,984, in which the $\lambda=1$ control is effected by means of a two-position controller and lean control is effected either via an altered desired value of the two-position controller or with the aid of a constant controller.

The invention is based on the object of improving an open-loop/closed-loop control system for setting the air/fuel mixture, particularly for a control in the lean range.

SUMMARY OF THE INVENTION

The open-loop/closed-loop control system according to the invention is characterized by the fact that the desired-value memory stores the inverse value of the air ratio λ. In dependence on the operating parameters of the internal combustion engine, the fuel-metering time read out of the basic memory for precontrolling the internal combustion engine for a predetermined air ratio λ is multiplicatively combined with the associated inverse value of the air ratio λ read out of the desired-value memory to obtain a fuel-metering time which is adapted to a change in the predetermined air ratio λ. A λ control is superimposed on the precontrol, in order to take into consideration the influence of interfering variables. For this purpose, the open-loop/closed-loop control system according to the invention has a conversion device which converts, with the aid of a probe-characteristic relationship between the output signal of the λ-probe and the air ratio λ, the output signal into a corresponding inverse value of the air ratio λ. A control deviation is supplied to the closed-loop control device of the open-loop/closed-loop control system according to the invention and this deviation is determined on the basis of the difference of inverse values of the air ratio λ read out of the desired-value memory in dependence on operating parameters of the internal combustion engine and the associated inverse values of the air ratio determined as actual values by the conversion unit on the basis of the output signal of the λ-probe.

Compared with the known systems, the open-loop/-closed-loop control system according to the invention has the advantage that, for example with a control in the lean range ($\lambda\cong0.9$ to 1.4), only one closed-loop control device is necessary in the entire range and additional elaborate circuit measures are avoided. The known closed-loop control systems control to the air ratio λ and vary the fuel-metering time in proportion to the control deviation. In reality, however, there is a non-linear relationship between the air ratio λ and the fuel quantity added. Thus, the air ratio λ is proportional to the inverse value of the fuel quantity and, conversely, the fuel quantity added is proportional to the inverse value of the air ratio λ. With a control to $\lambda=1$, a relatively small error is obtained with proportional fuel metering if the control deviation is kept sufficiently small since the air ratio λ is approximately identical with its inverse value in this range. To use such a closed-loop control device in the entire lean range, however, leads to considerable errors due to the non-linear relationship between the air ratio λ and the fuel quantity in fuel metering in the lean range. These errors are avoided in the open-loop/closed-loop control system according to the invention by controlling for the inverse value of the air ratio λ. The open-loop/closed-loop control system according to the invention has the advantage that the control is linear in the entire λ range to be controlled since the conversion device supplies the inverse value of the air ratio λ to the closed-loop control device and that the output signals of the λ-probe are not directly used for controlling as is usually done. Independently of the magnitude of the respective desired value, a particular percentage control error relative to the desired value corresponds to the same actuating variable so that the gain of the controller can be selected independently of the desired value.

In a preferred embodiment of the invention, the memories (basic memory, desired-value memory), the closed-loop control device and the conversion unit are functional units of a microcomputer. It is particularly advantageous to store the fuel-metering times, the desired values of the air ratio λ and the probe-characteristic relationship between the output signal of the λ-probe and the air ratio λ in characteristic fields which are addressed by means of the operating parameters of the internal combustion engine.

BRIEF DESCRIPTION OF THE DRAWING

An embodiment of the invention is shown in the figure and embodiments of the invention are explained in greater detail in the description which follows. The figure shows a block diagram of an embodiment of an open-loop/closed-loop control system which controls the fuel injection times on the basis of 1/λ values.

DESCRIPTION OF THE PREFERRED EMBODIMENTS OF THE INVENTION

The open-loop/closed-loop control system according to the figure has a basic memory 10 from which fuel-metering times $T_{LKF}$ are read for precontrolling an internal combustion engine (ICE) 12. The rotational speed n and a load characteristic L of the internal combustion engine 12 are used as input parameters for the basic memory 10. Depending on the existing sensor device, the throttle flap position of the internal combustion engine, the pressure in the intake pipe of the internal combustion engine or the air mass drawn in by the internal combustion engine can be used as load characteristic.

The open-loop/closed-loop control system also has a λ-probe 14, a conversion unit 16, a desired-value memory 18 and a closed-loop control device 20. The closed-loop control device 20 has a timing unit 20.1 and a correction device 20.2. Furthermore, a switch-over device 22 and a control-enable device 24 are provided.

The desired-value memory 18, which is, like the basic memory 10, addressable via the rotational speed and a load characteristic of the internal combustion engine, is subdivided into three sections. These sections are: a section in which the inverse values of the desired air ratio λ for λ greater than and less than 1 are stored; a section in which the desired inverse value of the air ratio λ=1 is stored for a control with catalytic converter; and a section in which desired inverse values of the air ratio λ are stored for controlling the internal combustion engine 12 in particular operating phases (for example start-up phase, acceleration phase, deceleration phase). The switch-over device 22 is supplied with the engine temperature $T_W$, the rate of change of a load characteristic dL/dt and the information whether there is a catalytic converter in the exhaust gas of the internal combustion engine. The switch-over device 22 drives, via a switch 22.1, on the basis of the magnitudes stated, the associated section in which the inverse value of the air ratio λ is stored as desired value and determines from which of the three sections the desired inverse values of the air ratio λ are read out.

The basic memory 10 is advantageously constructed as a characteristic field for fuel-metering times for an open-loop/closed-loop control to λ=1. Such a characteristic field is measured and tested for many vehicles. These fuel-metering times are usually set on a test stand.

The fuel-metering times $T_{LKF}$ read out of the basic memory 10 are multiplicatively combined with the inverse values of the air ratio λ which are read out of the desired-value memory in accordance with the position of the switch 22.1 of the switch-over device 22 and which, at the same time, represent correction factors (MFK). This results in the fuel-metering time $T_{LKF}$*. If the internal combustion engine 12 has not yet reached its operating temperature or if the internal combustion engine 12 is in an unstable phase (acceleration, deceleration), the fuel-metering time $T_{LKF}$* is used for precontrolling the internal combustion engine 12.

If the internal combustion engine 12 has reached its normal operating temperature and is operating in a stable mode, that is the amount of the rate of change of a load characteristic is less than a predetermined value, then the control-enable device 24 closes a switch 24.1 and the fuel-metering time $T_{LKF}$* is multiplicatively superposed by a correction factor FALK output by the closed-loop control device 20, which results in the fuel-metering time $T_E$. The determination of the correction factor FALK is explained in greater detail in the following.

Initially, the λ-probe 14 arranged in the exhaust gas of the internal combustion engine 12 outputs an output signal $U_S$ which is supplied to a conversion unit 16. Using an at least approximately known probe-characteristic relationship between the output signal of the λ-probe 14 and the air ratio λ, the conversion unit 16 determines the corresponding inverse value of the air ratio λ. This current inverse value of the air ratio λ is supplied to a comparator 26 as actual value. At the same time, a corresponding inverse value of the air ratio λ, read out of the desired-value memory 18, is present as desired value at the comparator 26. The difference between actual value and desired value of the air ratio λ is supplied as control error to the timing unit 20.1 of the closed-loop control device 20. The subsequent correction device 20.2 then determines the correction factor FALK.

A jump-like change in the air ratio λ with relatively large deviations of the desired value from the actual value, and thus a jump-like change in the fuel-metering time, results in a jump-like change in the torque of the internal combustion engine. The driver of an internal combustion engine notices this as a jolting behavior of the vehicle. This jolt is quite desirable in an acceleration process. However, a jolt produces negative sensations if a jump-like change (increase) in the air ratio λ into the lean range occurs in deceleration phases. Thus, for example, a jump towards the lean mixture of the air ratio of approximately 20% (for example λ desired old=1.2, λdesired new=1.3) entails a drop in power of approximately 10 to 15%. In order that this power drop does not occur suddenly, the desired 1/λ value is slowly lowered from the old desired 1/λ value to the new desired 1/λ value at a predetermined rate of lowering by means of a closed-loop down-control unit 27 in a preferred further development of the open-loop/closed-loop control system according to the invention. The rate of lowering has been selected to be a few percent change in desired value per second.

To increase the control accuracy, it is of advantage to filter out higher-frequency components of the probe signal which have their cause, for example, in a spread of the air/fuel mixture from cylinder to cylinder or in other interference signals, by means of a filtering device in order to prevent the probe signal from becoming "noisy".

In a particularly advantageous embodiment, all memories and devices of the open-loop/closed-loop control system are functional units of a microcomputer within an electronic control device. In this connection, it has been found to be advantageous to additionally provide a parameter adjusting device by means of which the parameters of a closed-loop control device having, for example, PID characteristics, can be varied. This makes it possible to use the electronic control device with the same configuration both for a $\lambda=1$ control and for a lean control. If a λ-probe of the Nernst type is provided, that is the output signal of the λ-probe exhibits a jump-like behavior in the region of $\lambda=1$, the closed-loop control device in a $\lambda=1$ control must exhibit a high rate of control in order to maintain a predetermined narrow catalytic converter window. This may lead to a deterioration in comfort with respect to the driving behavior since the control parameters for maintaining the catalytic converter window must be adjusted in such a manner that the closed-loop control device is operating close to its limit of oscillation. However, such a high rate of control, that is an operation of the closed-loop control device in the vicinity of its stability limit, is not required with a lean control because the probe signal exhibits a constant behavior in the lean range. The parameter adjusting device provides the possibility of optimally adjusting the closed-loop control device to the actual control concept ($\lambda=1$ control, lean control).

When a Nernst-type λ-probe is used, the output signal of the λ-probe is of a low magnitude in the lean range (approximately 100 to 30 mV). With the measuring devices used today in motor vehicle engineering, it is therefore necessary to amplify the output signal in the lean range (for example gain=7). The output signal is amplified by a factor of 4 to 5 in the range of $\lambda=1$ and it is not necessary to amplify the output signal in the rich range ($\lambda<1$). Considering this background, it is particularly advantageous to subdivide the conversion unit into three sections, namely a section for controlling in the range of $\lambda=1$ (for example between $\lambda=0.97$ and $\lambda=1.03$), a rich range (for example $\lambda<0.97$) and a lean range (for example $\lambda>1.03$). This reduces the computing time needed for determining the inverse λ-value from the measured output signal of the λ-probe.

We claim:

1. An open-loop/closed-loop control system for adjusting the air/fuel mixture of an internal combustion engine, the control system comprising:

a lambda probe exposed to the exhaust gas of the engine and emitting a lambda output signal indicative of the air ratio λ;

basic memory means for storing and reading out fuel-metering times in dependence upon operating parameters of the engine;

precontrol means for using said operating parameters to control said engine to a predetermined air ratio λ;

desired-value memory means for storing inverse values of the air ratio (λ) in dependence upon operating parameters of the engine;

conversion means for converting said output signal of said lambda probe into a corresponding inverse value (1/λ) of said air ratio (λ) as an actual value with the aid of a probe characteristic relationship between said output signal and said air ratio (λ), said characteristic relationship being known;

superposed λ-control means for correcting each of the fuel-metering times read out of said basic memory means in dependence upon the corresponding inverse value (1/λ) from said conversion means and an associated inverse value read out of said desired-value memory means; and, said superposed λ-control means including multiplicative combining means for multiplicatively combining the fuel-metering time read out of said basic memory means with said inverse value of the air ratio (λ) read out of said desired-value memory mans to obtain a fuel-metering time adapted to a change in the pregiven air ratio (λ).

2. The control system of claim 1, comprising a microcomputer defining all of said basic memory means, said desired-value memory means and said conversion means.

3. The control system of claim 2, wherein the stored values of said basic memory means, of the desired-value memory means and of the probe-characteristic relationship between the output signal of the λ-probe and the air ratio λ are stored in characteristic fields which are addressable by means of operating parameters of the internal combustion engine.

* * * * *

UNITED STATES PATENT AND TRADEMARK OFFICE

CERTIFICATE OF CORRECTION

PATENT NO. : 5,040,513

DATED : August 20, 1991

INVENTOR(S) : Eberhard Schnaibel and Erich Schneider

It is certified that error appears in the above-identified patent and that said Letters Patent is hereby corrected as shown below:

In the title page, in the Abstract, line 24: delete "vario" and substitute -- ratio -- therefor.

In column 6, line 39: delete "mans" and substitute -- means -- therefor.

Signed and Sealed this

Fourth Day of May, 1993

Michael K. Kirk

MICHAEL K. KIRK

*Acting Commissioner of Patents and Trademarks*

*Attest:*

*Attesting Officer*